US010043371B2

(12) United States Patent
Fusco et al.

(10) Patent No.: US 10,043,371 B2
(45) Date of Patent: Aug. 7, 2018

(54) AQUATIC EPIDEMIC ALERT METHODS AND SYSTEMS

(71) Applicant: INTERNATIONAL BUSINESS MACHINES CORPORATION, Armonk, NY (US)

(72) Inventors: Francesco Fusco, Kildare (IE); Sean McKenna, Dublin (IE); Fearghal O'Donncha, Galway (IE); Emanuele Ragnoli, Dublin (IE)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/296,245

(22) Filed: Oct. 18, 2016

(65) Prior Publication Data

US 2018/0108240 A1 Apr. 19, 2018

(51) Int. Cl.
*G08B 21/00* (2006.01)
*G08B 21/10* (2006.01)

(52) U.S. Cl.
CPC ..... *G08B 21/10* (2013.01)

(58) Field of Classification Search
CPC ..... G08B 21/10; G01S 7/411
USPC ..... 340/603, 606, 612, 627, 633
See application file for complete search history.

(56) References Cited

U.S. PATENT DOCUMENTS

| | | | | |
|---|---|---|---|---|
| 5,633,644 | A * | 5/1997 | Schussler | G01S 13/91 342/41 |
| 7,140,323 | B2 | 11/2006 | Ashworth et al. | |
| 8,216,825 | B2 | 7/2012 | Yuan | |
| 8,612,129 | B2 * | 12/2013 | Gagliardi | G08G 3/02 342/41 |
| 8,753,878 | B2 | 6/2014 | Kriman Fleiderman et al. | |
| 2011/0158946 | A1 | 6/2011 | Duryasula et al. | |
| 2017/0090017 | A1 * | 3/2017 | Lenes | G01S 7/411 |

FOREIGN PATENT DOCUMENTS

| | | | |
|---|---|---|---|
| CN | 203324783 | U | 12/2013 |
| WO | 2010027788 | A1 | 3/2010 |

* cited by examiner

*Primary Examiner* — Tai T Nguyen
(74) *Attorney, Agent, or Firm* — Griffiths & Seaton PLLC

(57) ABSTRACT

Embodiments for providing aquatic epidemic alerts by a processor are described. Information associated with an aquatic epidemic in a body of water is received. A threat level associated with the aquatic epidemic for a location within the body of water is determined based on the information associated with the aquatic epidemic and water flow data associated with the body of water. An indication of the threat level is generated.

21 Claims, 7 Drawing Sheets

AQUATIC EPIDEMIC ALERT METHODS AND SYSTEMS

BACKGROUND OF THE INVENTION

Field of the Invention

The present invention relates in general to computing systems, and more particularly, to various embodiments for providing aquatic epidemic alerts.

Description of the Related Art

Aquaculture, also known as aquafarming, is the farming of aquatic organisms, such as fish, crustaceans, mollusks, and aquatic plants. Aquaculture involves cultivating freshwater and saltwater populations under controlled conditions, and can be contrasted with commercial fishing, which is the harvesting of wild fish. The aquaculture industry has grown significantly over the past few decades, and according to some estimates, now accounts for approximately 50% of all fish and shellfish that is now directly consumed by humans.

One of the problems encountered by the aquaculture industry is that of "aquatic epidemics," such as infectious agents carried by aquatic wildlife, organisms (e.g., bacteria, sea lice, red tide, etc.) floating in the water, and pollution (e.g., oil spills). These epidemics can significantly impact the yields of aquaculture farms (or aquaculture sites), resulting in the loss of product and investments made in the industry.

SUMMARY OF THE INVENTION

Various embodiments for providing aquatic epidemic alerts by a processor are described. In one embodiment, by way of example only, a method for providing an aquatic epidemic alert, again by a processor, is provided. Information associated with a aquatic epidemic in a body of water is received. A threat level associated with the aquatic epidemic for a location within the body of water is determined based on the information associated with the aquatic epidemic and water flow data associated with the body of water. An indication of the threat level is generated.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
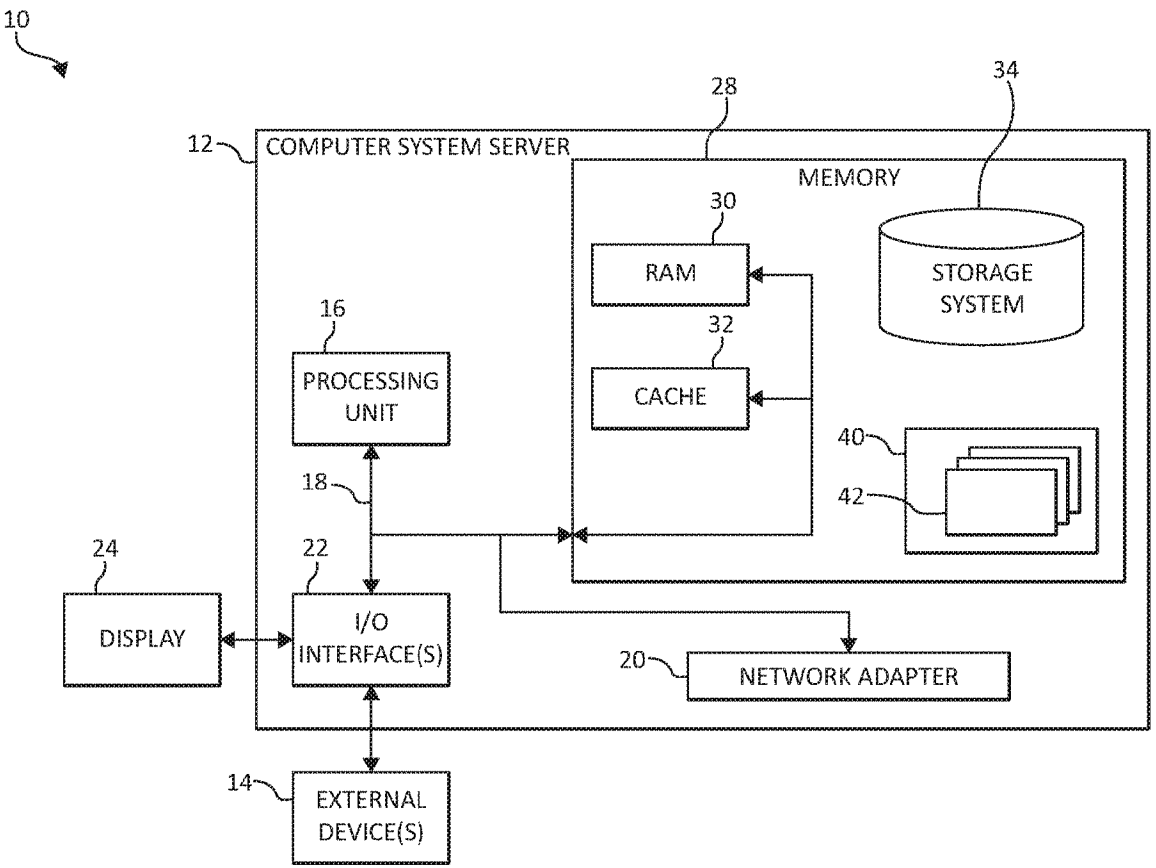
FIG. 1 is a block diagram depicting an exemplary computing node according to an embodiment of the present invention.

As previously indicated, the aquaculture industry has grown significantly in recent years and accounts for a significant portion of the fish and shellfish that is now directly consumed by humans. Aquatic epidemics, such as infectious agents carried by aquatic wildlife, organisms (e.g., bacteria, sea lice, red tide, etc.) floating in the water, and pollution (e.g., oil spills) can significantly impact the yields of aquaculture farms, resulting in the loss of product and investments made in the industry. Current aquatic epidemic alert systems are undesirable for several reasons.

Current aquatic epidemic alert systems often do not provide sufficient protection for the industry because, for example, the system(s) only target one type of risk/epidemic, cover relatively large areas (i.e., as opposed to specific areas such as where a particular aquaculture farm is located), have poor time resolution (e.g., seasonal or annual), and/or are simply based on historical data or current aquaculture production data (i.e., as opposed to the current conditions/status of the pertinent bodies of water).

For example, some aquatic epidemic alert systems only target (or monitor for) specific types of aquatic epidemics. Thus, it is possible that an aquaculture operator will simply not be alerted to the threat of a different type of epidemic that may pose a threat to his/her farm. Some alert systems cover relatively large areas and/or have very "coarse" time resolution. That is, when an alert is signaled, the alert is provided for a large area, as opposed to providing which specific areas of the body of water are at risk, and/or cover a long period of time (e.g., a year, a season, etc.), as opposed to alerting operators of specific risks that have actually manifested (and/or been detected) in nearby waters. Ideally, aquatic epidemic alert systems would, for example, provide operators at a specific location with current information related to the presence of an epidemic that may impact their farm and provide a forecast of the impact of the epidemic on their farm.

In view of the foregoing, a need exists for aquatic epidemic alert methods and systems that provide operators at a specific location with current information related to the presence of an epidemic which may impact their farm and provide a forecast of the impact of the epidemic on their farm.

To address these needs, the methods and systems of the present invention provide, for example, quantitative forecasts of epidemic risks for aquaculture sites, quantitative forecasts of the time of arrival and the density of the epidemic(s) detected, an information technology framework for the transmission and update of a user's defined messages related to epidemic swarms, and a modeling platform for the forecast ad monitoring of swarms and particles.

In some embodiments, the methods and systems use, for example, real-time information associated with detected/ observed aquatic epidemics combined with the characteristics of the pertinent body of water to determine a threat level (or risk) posed by aquatic epidemics to specific locations in (or near) the body of water (e.g., the locations of aquaculture sites). In some embodiments, an indication of the threat level is generated and provided to a user (e.g., an operator of a particular aquaculture site). If any of the information used to determine the threat level is updated, the threat level may be re-determined and again provided to the user (i.e., the methods/systems may be updated in "real-time").

The information associated with the detected aquatic epidemic may include, for example, the type of epidemic, the position of the epidemic, the time of the detection/observation, the density of the epidemic, the mass of the epidemic, and/or the extension (or extent) (e.g., the associated surface area of water) of the epidemic. This information may include (or be based on), for example, observations made by maritime personnel (e.g., ship captains, etc.) and/or aerial detections (e.g., via aircraft and/or satellites).

The characteristics of the body of water that are used to determine the threat posed by the epidemic may include water circulation/flow data (e.g., current direction(s) and strength(s)). As will be appreciated by one skilled in the art, such data may be made available by various organizations (e.g., through military channels) and accessed through external databases.

The determination of the threat level may be based on, for example, the pertinent characteristics of the epidemic (e.g., position and type) and the water flow data. The determined threat level may include (and/or be based on) an expected time of arrival for the epidemic at a particular location (e.g., an aquaculture site) and/or an anticipated impact of the epidemic on the location (e.g., a calculated mass or density of the epidemic when it arrives at the location). The severity of the threat may vary depending on the type of epidemic and the exact type of aquaculture site in question (e.g., particular types of epidemics may be more or less harmful to particular types of aquaculture site). In some embodiments, a Lagrangian and/or Eulerian particle tracking method is utilized to determine the threat level (e.g., determine the time of arrival and/or the density of the epidemic).

The indication of the threat level may be provided by, for example, an electronic message (e.g., text message, email, etc.), visual messages (e.g., on display screens), and/or aural messages (e.g., recorded messages, buzzers, etc.).

The methods and systems described herein may provide alerts of aquatic epidemics in high resolution, with respect to both time and space, compared to conventional alert systems, allow for (and/or utilize) updates by re-initializing the methodology once new observations of the swarm are detected and recorded, and provide alerts for any type of epidemic and different types of risk metrics.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, a schematic of an example of a cloud computing node is shown. Cloud computing node 10 is only one example of a suitable cloud computing node and is not intended to suggest any limitation as to the scope of use or functionality of embodiments of the invention described herein. Regardless, cloud computing node 10 is capable of being implemented and/or performing (or causing or enabling) any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 1, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, system memory 28 may include at least one program product having a set (e.g., at least one) of program modules that are configured to carry out the functions of embodiments of the invention.

Program/utility 40, having a set (at least one) of program modules 42, may be stored in system memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples include, but are not limited to: microcode, device drivers, redundant processing units, external disk drive arrays, RAID systems, tape drives, and data archival storage systems, etc.

In the context of the present invention, and as one of skill in the art will appreciate, various components depicted in FIG. 1 may be located in, for example, personal computer systems, hand-held or laptop devices, and network PCs. However, in some embodiments, some of the components depicted in FIG. 1 may be located in a computing device in a warehouse (e.g., at an aquaculture site), a vessel (e.g., ship), and/or a satellite. For example, some of the processing and data storage capabilities associated with mechanisms of the illustrated embodiments may take place locally via local processing components, while the same components are connected via a network to remotely located, distributed computing data processing and storage components to accomplish various purposes of the present invention. Again, as will be appreciated by one of ordinary skill in the art, the present illustration is intended to convey only a subset of what may be an entire connected network of distributed computing components that accomplish various inventive aspects collectively.

Figure 2:
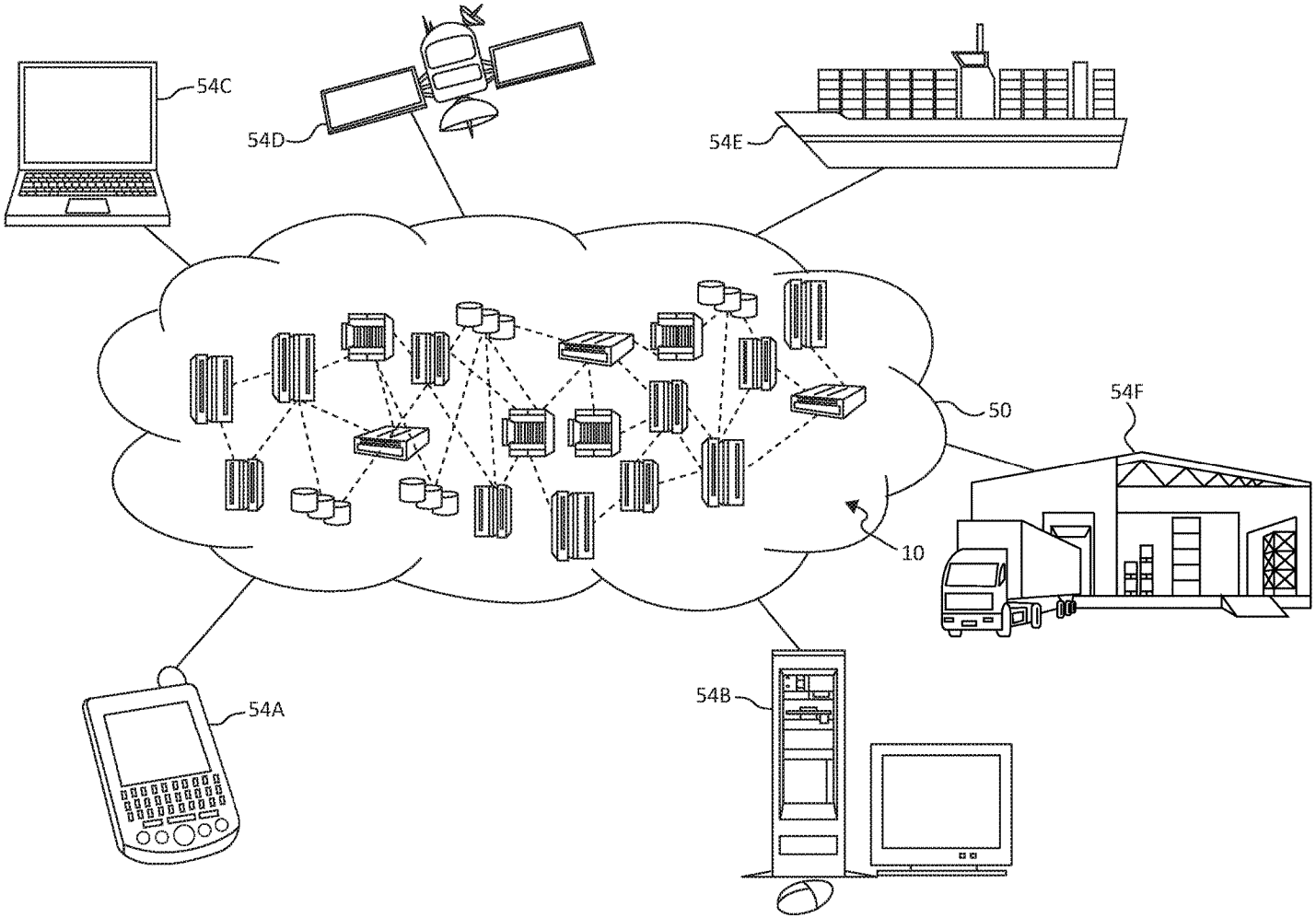
FIG. 2 is an additional block diagram depicting an exemplary cloud computing environment according to an embodiment of the present invention.

Referring now to FIG. 2, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, and/or laptop computer 54C, and others computer systems, such as, for example, those in satellites 54D, vessels 54E, and/or aquaculture farms 54F, may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-F shown in FIG. 2 are intended to be illustrative only and that computing nodes 10 and cloud computing environment 50 can communicate with any type of computerized device over any type of network and/or network addressable connection (e.g., using a web browser).

Figure 3:
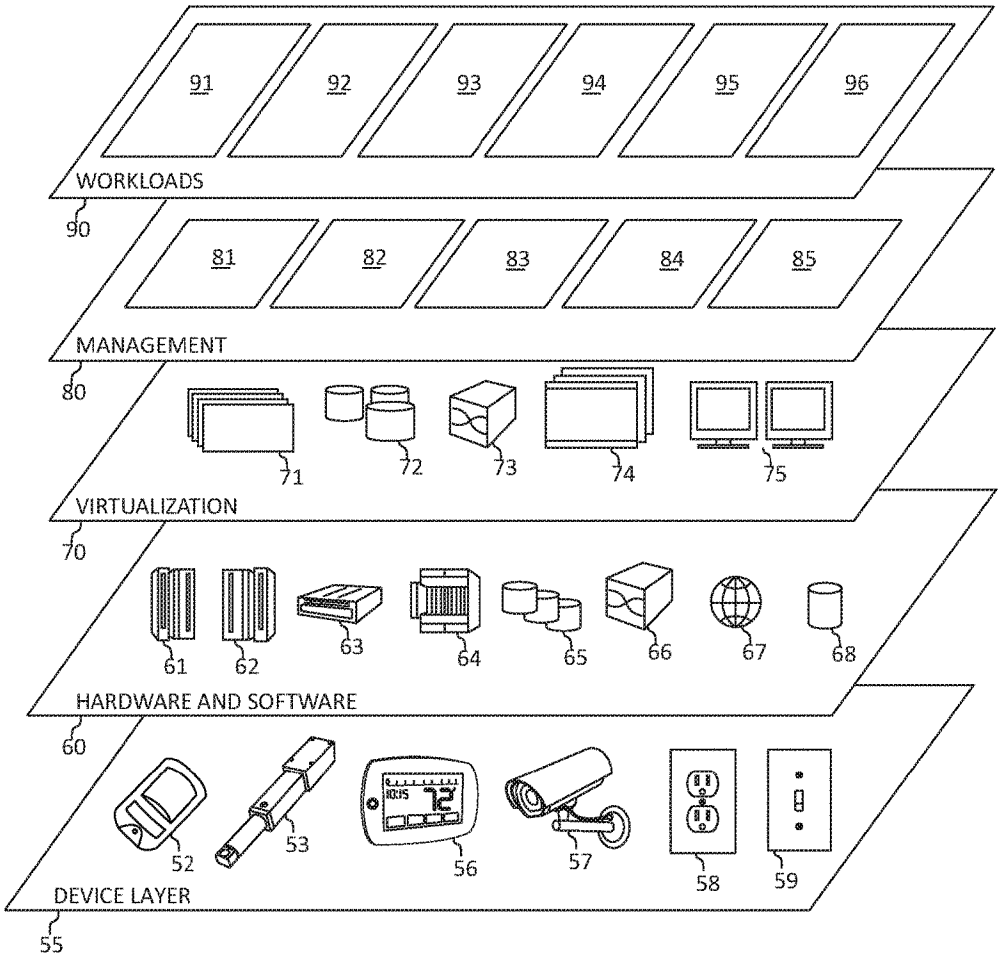
FIG. 3 is an additional block diagram depicting abstraction model layers according to an embodiment of the present invention.

Referring now to FIG. 3, a set of functional abstraction layers provided by cloud computing environment 50 (FIG. 2) is shown. It should be understood in advance that the components, layers, and functions shown in FIG. 3 are intended to be illustrative only and embodiments of the invention are not limited thereto. As depicted, the following layers and corresponding functions are provided:

Device layer 55 includes physical and/or virtual devices, embedded with and/or standalone electronics, sensors, actuators, and other objects to perform various tasks in a cloud computing environment 50. Each of the devices in the device layer 55 incorporates networking capability to other functional abstraction layers such that information obtained from the devices may be provided thereto, and/or information from the other abstraction layers may be provided to the devices. In one embodiment, the various devices inclusive of the device layer 55 may incorporate a network of entities collectively known as the "internet of things" (IoT). Such a network of entities allows for intercommunication, collection, and dissemination of data to accomplish a great variety of purposes, as one of ordinary skill in the art will appreciate.

Device layer 55 as shown includes sensor 52, actuator 53, "learning" thermostat 56 with integrated processing, sensor, and networking electronics, camera 57, controllable household outlet/receptacle 58, and controllable electrical switch 59 as shown. Other possible devices may include, but are not limited to drones, satellites, vessels, and various additional sensor devices, networking devices, electronics devices (such as a remote control device), additional actuator devices, so called "smart" appliances such as a refrigerator or washer/dryer, and a wide variety of other possible interconnected objects.

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provides cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and, in the context of the illustrated embodiments of the present invention, various workloads and functions 96 for detecting aquatic epidemics and/or determining the risks posed by aquatic epidemics. One of ordinary skill in the art will appreciate that the image processing workloads and functions 96 may also work in conjunction with other portions of the various abstractions layers, such as those in hardware and software 60, virtualization 70, management 80, and other workloads 90 (such as data analytics processing 94, for example) to accomplish the various purposes of the illustrated embodiments of the present invention.

As previously mentioned, the methods and systems of the illustrated embodiments provide novel approaches for alerting users of the threats/risks posed by aquatic epidemics. The methods and systems include a data collection aspect, where a variety of information may be collected about one or more aquatic epidemics. Additionally, the information may include, for example, the current date/season and weather data (e.g., wind speed and direction, barometric pressure, temperature, chance of participation, etc.) associated with the region(s) in which an aquatic epidemic is detected.

Figure 4:
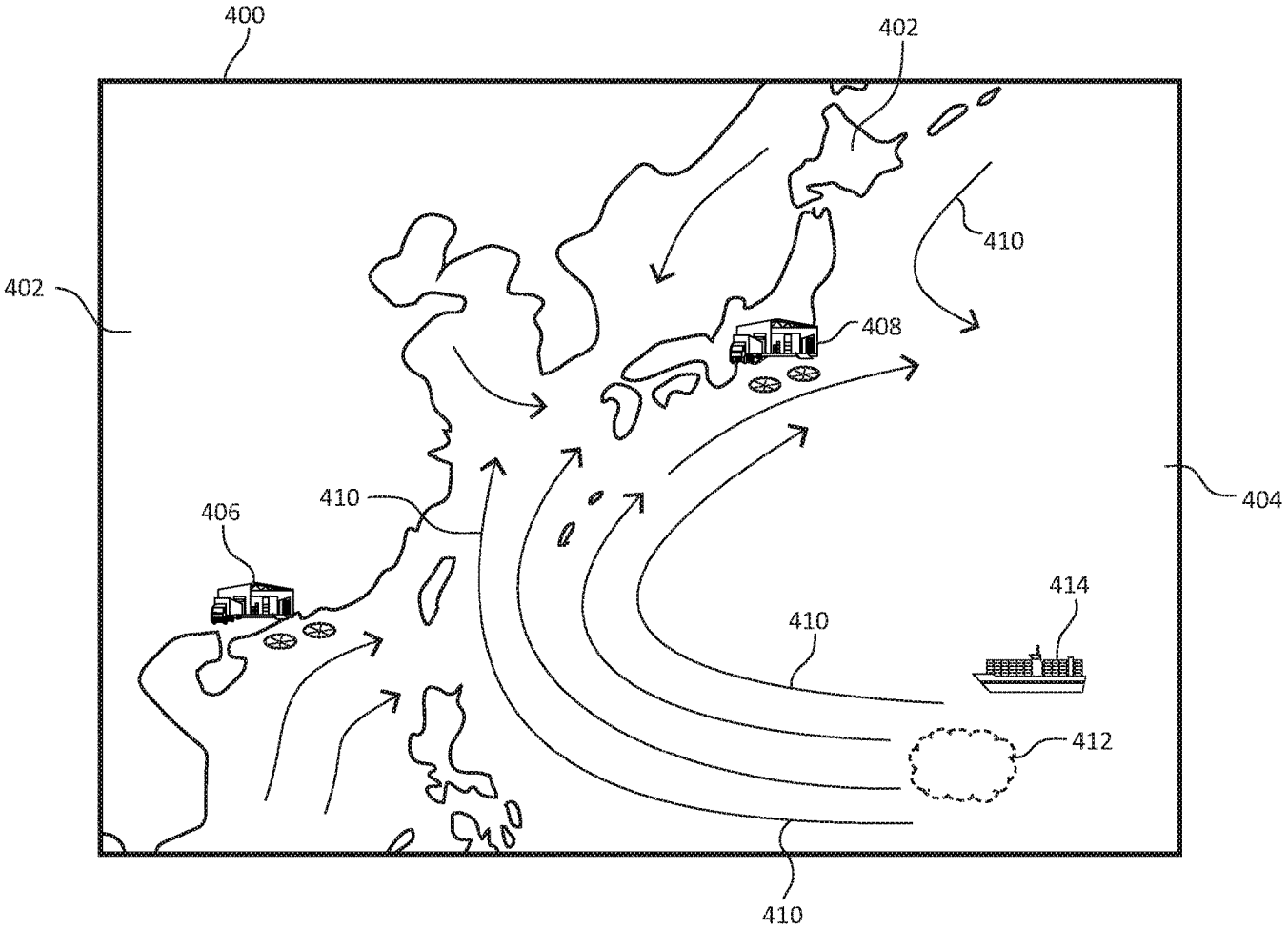
FIG. 4 is a plan view of a map having aquaculture sites, an aquatic epidemic, a vessel, and water flows indicated thereon in accordance with aspects of the present invention.

Referring to FIG. 4, a map 400 of an exemplary geographic region is shown. The region shown on the map 400 includes a land mass (or masses) 402 and a body of water 404. Although the body of water 404 shown may resemble an ocean, sea, or lake, it should be understood that the body of water may be of any type, including rivers and streams. On (or near) the land mass 402 are located two aquaculture sites (aquaculture farms or aquafarms) 406 and 408. Water flow (and/or currents) within the body of water 404 is indicated by arrows 410. In the depicted embodiment, an aquatic epidemic 412 is shown in the body of water 404, with a vessel (e.g., a cargo ship) 414 nearby.

In some embodiments, the presence of the aquatic epidemic 412 is detected (or observed) by the vessel 414 (e.g., by personnel on the vessel). The aquatic epidemic 412 may be any condition of the water that may be harmful to, for example, the aquaculture sites 406 and 408. Examples include, but are not limited to, biological epidemics, such as infectious agents carried by aquatic wildlife, organisms (e.g., bacteria, sea lice, red tide, etc.) floating in the water, and pollution epidemics (e.g., oil spills). Various information associated with the epidemic 412 may be collected by the vessel, such as the type of epidemic, the position of the epidemic, the time of the detection/observation, the density of the epidemic, the mass of the epidemic, and/or the extension (or extent) (e.g., the associated surface area of water) of the epidemic. Although the depicted embodiment shows the observation/detection of the epidemic 412 being made by a vessel 414, it should be understood that the observation may also be made by, for example, satellites (e.g., satellite imaging) and/or aircraft, perhaps in combination with the vessel 414. The information associated with the aquatic epidemic 412 may be sent to a central database and/or uploaded to a server or website.

In some embodiments, the information associated with the aquatic epidemic is then used in combination with characteristics of the body of water to determine the threat/risk posed by the epidemic 412 to the aquaculture sites 406 and 408. As shown in FIG. 4, the characteristics associated with the body of water 404 may include water flow data (e.g., current directions, dimensions, strengths, etc.), indicated by arrows 410. As will be appreciated by one skilled in the art, such data may be made available by various organizations (e.g., military organizations).

In some embodiments, the determination of the threat posed by the epidemic 412 includes determining an expected time of arrival of the epidemic to particular locations (e.g., aquaculture sites) and/or the severity, density, or mass of the epidemic when it arrives. Lagrangian and/or Eulerian particle tracking methods, as will be appreciated by one skilled in the art, may be used to determine the time of arrival and/or the density and/or mass of the epidemic at the time of arrival. It should be noted that depending on various factors, such as the exact locations of the epidemic 412 and aquaculture sites 406 and 408, the time of arrival and/or density may vary for different locations. For example, referring to FIG. 4, because of the direction of the water flow 410, the epidemic 412 may be more likely to effect aquaculture site 408 than aquaculture site 406. Further, depending on the exact type of epidemic 412 and the strength of the water flow 410, it may be determined that is relatively unlikely that the epidemic 412 will pose any threat to aquaculture site 406 (e.g., the epidemic 412 may not reach aquaculture site 406). It should be noted that other types of data associated with the body of water 404, such as weather data, may be used in determining the time of arrival and/or the density of the epidemic at the aquaculture sites 406 and 408 (e.g., wind conditions and/or barometric pressure may influence the movement of the epidemics).

The determination of the threat level may also include (and/or be based on) the type of aquatic epidemic detected and the type of stock at particular aquaculture sites. For example, certain types of aquaculture stock (e.g., fish) may be particularly prone to being damaged by particular types of aquatic epidemics, while some aquatic epidemics may be equally harmful to all types of aquaculture stock.

In this manner, a threat level may be determined for one of more of the aquaculture sites 406 and 408. The threat level may include one or more aspects, such as, a probability (e.g., percentage chance) that the detected epidemic 412 will arrive at aquaculture sites 406 and 408, the expected/calculated time of arrival (i.e., if the epidemic will reach the particular aquaculture sites in question), the mass and/or density of the epidemic at the time of arrival, and/or description of how severe the impact of the epidemic is expected to be on the aquaculture sites 406 and 408 (e.g., "mild," "moderate," "severe," etc.).

After the threat level has been determined, an indication of the threat level may be generated and provided to appropriate personnel (and/or an automated system). The indication may be in the form of, for example, an electronic message (e.g., text message, email, etc.), a visual message (e.g., on a display screen), and/or an aural message (e.g., a recorded message, buzzer, etc.). The indication may be sent to an individual (e.g., an administrator at one of the aquaculture sites 406 and 408) via a personal message (e.g., a text message) or sent to a computer system associated with (e.g., located at) an aquaculture site. In some embodiments, the indication (or message) includes not only the determined aspects of the threat (e.g., time of arrival) but also the information associated with the epidemic gathered at the initial (or latest) observation (e.g., time, place, extent, and/or type of epidemic).

In some embodiments, when more than one aquaculture site is potentially at risk from the epidemic, different threat levels (or indications thereof) are sent to different aquaculture sites when appropriate. For example, still referring to FIG. 4, as described above, because of the water flow 410 shown, the likelihood that the aquatic epidemic 412 will reach aquaculture site 408 may be significantly higher than it reaching aquaculture site 406. In such an example, the threat level indicated for aquaculture site 408 may include a higher probability of arrival than the threat level indicated for aquaculture site 406. However, if the particular epidemic 412 detected is particularly harmful to the stock at aquaculture site 406, this may also be indicated in the threat level, but perhaps in combination with a relatively low probability of arrival. Thus, the methods and system provided herein are able to customize the alerts to not only the locations of the aquaculture sites but also the types of aquatic life being cultivated at the aquaculture sites.

In the event that any information associated with the aquatic epidemic 412 (and/or the water flow 412 data and/or weather data) changes/is updated, the threat level may be re-determined. For example, the vessel 414, or another vessel or an aircraft, may observe the epidemic 412 at a later time than the initial report and provide different information, such as the position, extent, and/or density of the epidemic 412 has changed, perhaps in an unanticipated manner. In such an event, the threat level for the aquaculture site(s) may be re-determined, or updated, and the new threat level may be communicated in the manner(s) described above. Thus, the methods and system provided herein are able to provide updated alerts in real-time as the observed characteristics of the epidemic(s) change.

Figure 5:
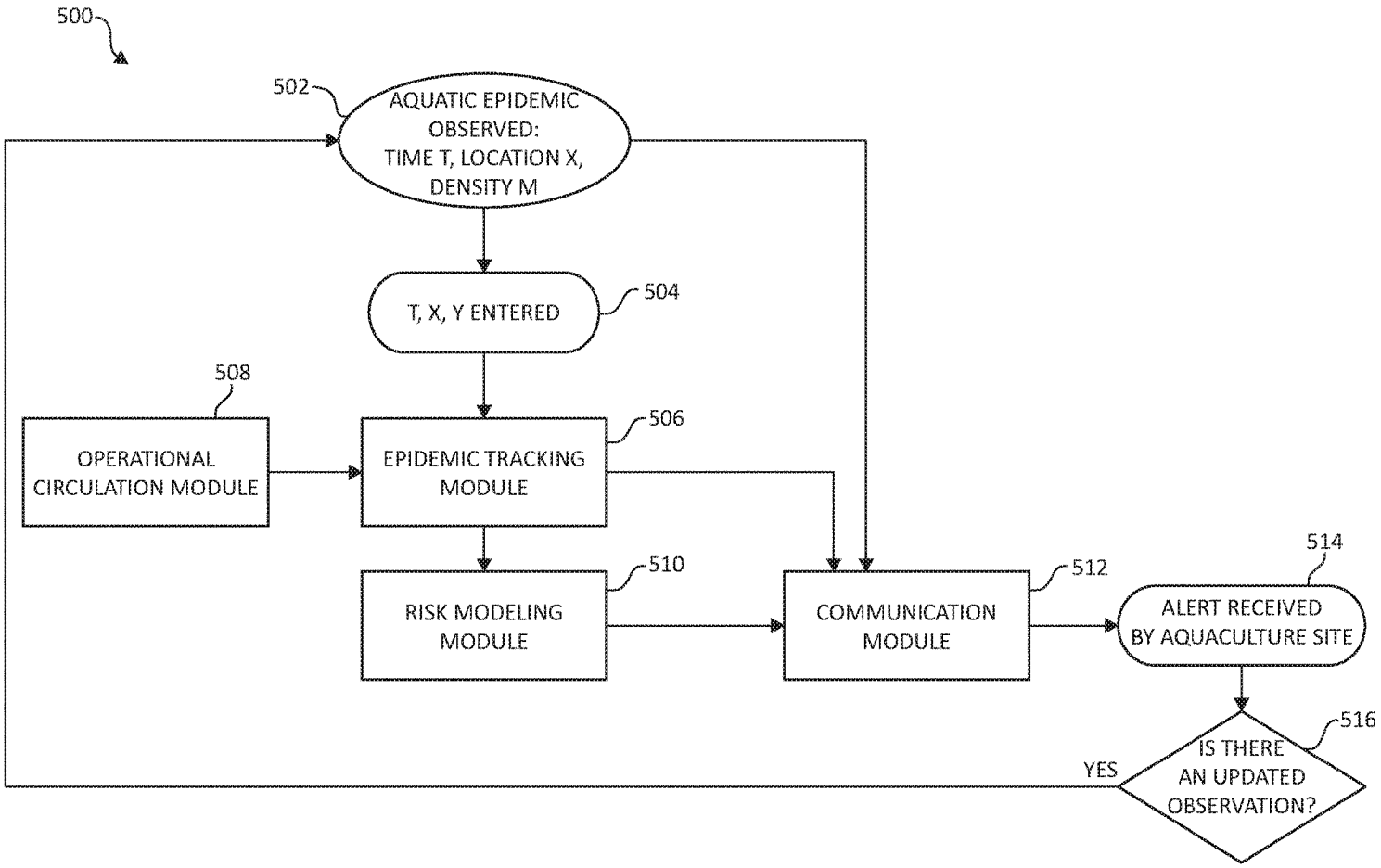
FIG. 5 is a block/flow diagram illustrating certain aspects of functionality according to the present invention.

FIG. 5 is a simplified functional block diagram/flowchart 500 of the methods and/or systems described herein according to some embodiments. At step (or block) 502, an (initial) detection/observation of an aquatic epidemic is made. The detection may include observing/recording the type of epidemic, along with, for example, the time (T) of the observation, the location of the epidemic (or observation) (X), and the density of the epidemic (M).

At step 504, information gathered during the detection/observation of the aquatic epidemic is entered to epidemic tracking block (or module) 506 (e.g., by uploading the information to a server or website). The epidemic tracking block 506 retrieves water flow data from operational circulation block 508 and may calculate an expected time of arrival and/or density of the aquatic epidemic at a particular location (e.g., aquaculture sites 406 and/or 408 in FIG. 4).

In the depicted embodiment, the expected time of arrival and/or expected density is sent to risk modeling block 510 and communication block 512. The risk modeling block 510 determines the risk/threat level posed by the observed aquatic epidemic to the particular location. For example, as described above, certain types of epidemics may be more or less harmful to particular aquaculture sites based on, for example, the type of stock at the aquaculture sites.

The communication module 512 then generates an indication (or alert), such as an electronic message, etc., which is then sent to/received by the aquaculture site (and/or personnel thereof), as shown at step 514. The indication may include a, for example, the expected time of arrival, the expected density, and the risk posed by the detected epidemic to the particular aquaculture site. As such, it should be understood that the "threat level" communicated to the aquaculture site may include one of more aspects of the potential threat (e.g., time of arrival, risk, etc.).

At step 516 when (or if), an updated observation of (or updated information about) the aquatic epidemic is received, the system returns to step 502 and the process is repeated, resulting in an update alert being sent to the aquaculture site.

Figure 6:
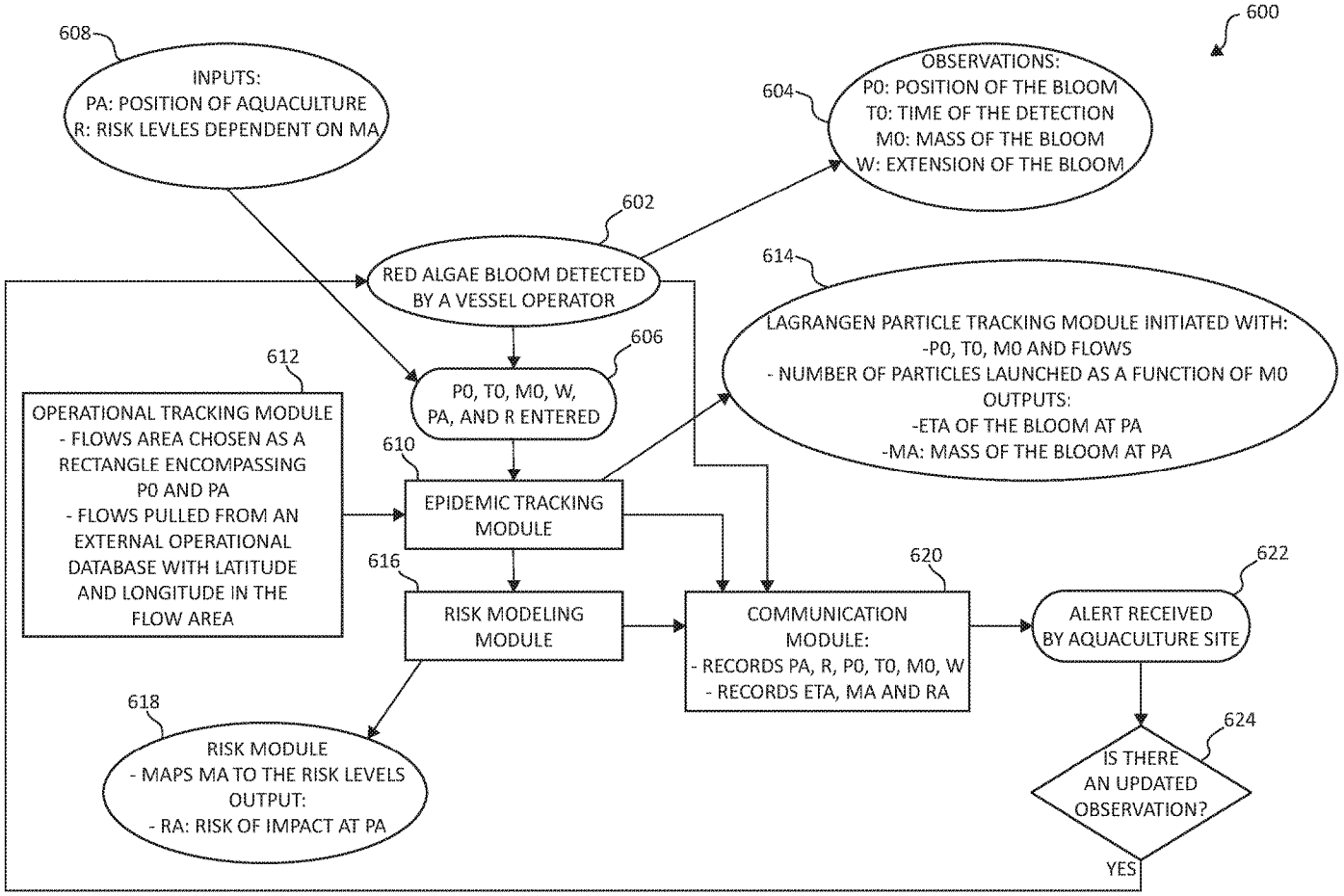
FIG. 6 is a block/flow diagram again illustrating certain aspects of functionality according to the present invention.

FIG. 6 is a simplified functional block diagram/flowchart 600 of the methods and/or systems described herein, providing additional details according to some embodiments. At step (or block) 602, an (initial) detection/observation of an aquatic epidemic, in this case a red algae bloom, is made. Observations (or characteristics) of the red algae bloom include the position of the bloom (P0), the time of the observation/detection (T0), the mass of the bloom (M0), and the extension of the bloom (W), as shown in block 604.

At step 606, the observations of the red algae bloom, P0, T0, M0, and W, along with details of an aquaculture site, the position of the site (PA) and risk/threat levels associated with the bloom at the aquaculture site based on the mass of the bloom at the site (R), are sent to (or entered into) epidemic tracking module 610 as well as operational tracking module 612 (e.g., by uploading the information to a server or website).

In the depicted embodiment, the operational tracking module 612 selects an area (e.g., a rectangular area) encompassing the observed position of the bloom (P0) and the position of the aquaculture site (PA) and retrieves water flow data for the appropriate coordinates (e.g., longitude and latitude) from, for example, an external database as described above. The appropriate water flow data is sent to the epidemic tracking module 610.

In the depicted embodiment, the epidemic tracking module 610 then determines the expected time of arrival (ETA) of the bloom at the aquaculture site (PA) and the mass of the bloom at the aquaculture site (MA) using, for example, a Lagrangian particle tracking method (e.g., using P0, T0, M0, the water flow data, and the number of particles of the bloom launched as function of M0), as indicated at block 614.

Risk modeling module 616 then maps the calculated mass of the bloom at the aquaculture site (MA) to risk levels and outputs the risk/threat of the impact/arrival of the bloom at the aquaculture site (PA), as shown in block 618.

Communication module 620 receives and records the position of the aquaculture site (PA), risk/threat levels associated with the bloom at the aquaculture site based on the mass of the bloom at the site (R), the observed position of the bloom (P0), the time of the observation (T0), the mass of the bloom (M0), the extension of the bloom (W), the expected time of arrival (ETA), the calculated mass of the bloom at the aquaculture site (MA), and the risk of impact (RA) from the appropriate modules/blocks 602, 610, and 618, which are then sent to the aquaculture site as a message/alert, as shown in block 622.

At step 624 when (or if), an updated observation of (or updated information about) the aquatic epidemic is received, the system returns to step 602 and the process is repeated, resulting in an updated alert being sent to the aquaculture site.

Figure 7:
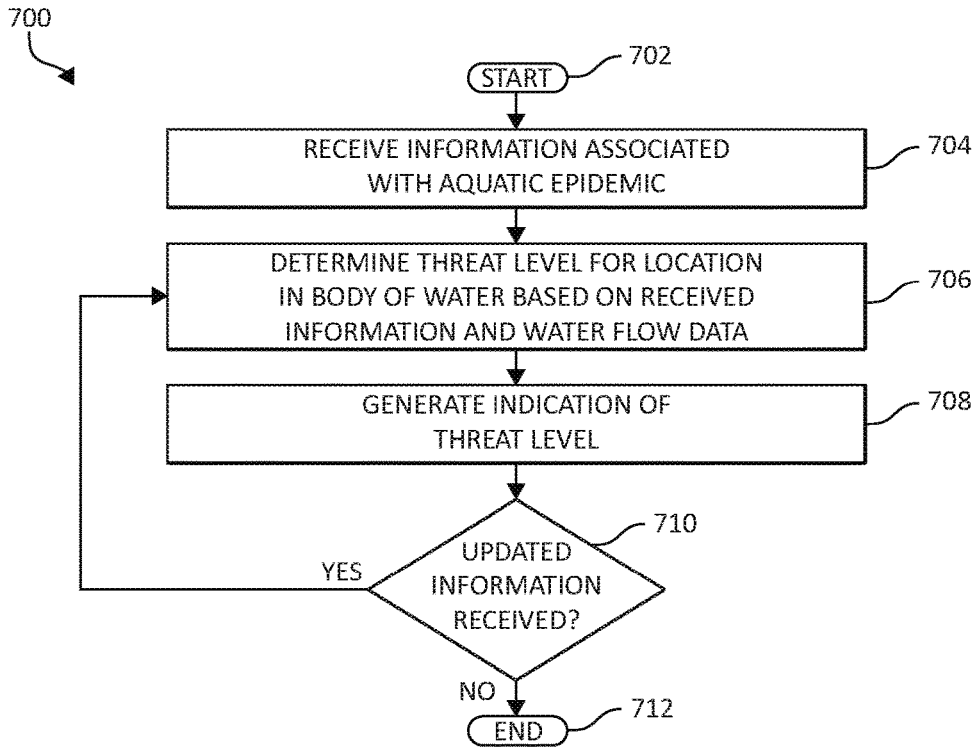
FIG. 7 is a flowchart diagram depicting an exemplary method for providing an aquatic epidemic alert in which various aspects of the present invention may be implemented.

Turning to FIG. 7, a flowchart diagram of an exemplary method 700 for providing an aquatic epidemic alert, in accordance with various aspects of the present invention, is illustrated. Method 700 begins (step 702) with, for example, an aquatic epidemic being observed or detected. As described above, the observation of the aquatic epidemic may be made by, for example, personnel on a vessel and/or aerially (e.g., by an aircraft or a satellite). Information associated with (or about) the aquatic epidemic may be obtained during the observation.

The information may include, for example, the type of epidemic, the position of the epidemic, the time of the detection/observation, the density of the epidemic, the mass of the epidemic, and/or the extension of the epidemic. The information associated with the aquatic epidemic is received (e.g., uploaded/sent to a server, website, database, etc.) (step 704).

A threat level (or risk) posed by the aquatic epidemic for a particular location (e.g., an aquaculture site) is then determined based on the received information about the epidemic and water flow data associated with the respective body of water (step 706). The determined threat level may include (and/or be based on) an expected time of arrival for the epidemic at a particular location (e.g., an aquaculture site) and/or an anticipated impact of the epidemic on the location (e.g., a calculated mass or density of the epidemic when it arrives at the location). The severity of the threat may vary depending on the type of epidemic and the exact type of aquaculture site in question (e.g., particular types of epidemics may be more or less harmful to particular types of aquaculture sites). In some embodiments, a Lagrangian and/or Eulerian particle tracking method is utilized to determine the threat level (e.g., determine the time of arrival and/or the density of the epidemic).

An indication of the threat level (or an alert or a message) is then generated (step 708). The indication of the threat level may be provided by, for example, an electronic message (e.g., text message, email, etc.), visual messages (e.g., on display screens), and/or aural messages (e.g., recorded messages, buzzers, etc.). The indication may be provided (or sent to), for example, the aquaculture site at risk by the aquatic epidemic (or personnel associated with the aquaculture site).

If updated information about the aquatic epidemic is received (e.g., from a subsequent observation of the epidemic) (step 710), method 700 again determines (or redetermines) the threat level based on the updated information (step 706), and an indication of the updated threat level is generated (step 708). If no updated information has been received (step 710), method 700 ends (step 712) with, for example, the epidemic ending (e.g., dispersing and/or moving into an area of the body of water where it no longer poses any threat).

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowcharts and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowcharts and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowcharts and/or block diagram block or blocks.

The flowcharts and block diagrams in the Figures illustrate the architecture, functionality, and operation of possible implementations of systems, methods, and computer program products according to various embodiments of the present invention. In this regard, each block in the flowcharts or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts or carry out combinations of special purpose hardware and computer instructions.

The invention claimed is:

1. A computer-implemented method, by a processor executing instructions stored in a memory device, for providing an aquatic epidemic alert, comprising:

receiving information associated with an aquatic epidemic in a body of water, the aquatic epidemic including at least one of infectious agents carried by aquatic wildlife and infectious organisms floating in the body of water;

determining a threat level associated with the aquatic epidemic for a location within the body of water based on the information associated with the aquatic epidemic and water flow data associated with the body of water; and generating an indication of the threat level.

2. The method of claim 1, wherein the information associated with the aquatic epidemic includes at least one of a position of the aquatic epidemic within the body of water or an extent of the aquatic epidemic.

3. The method of claim 1, further including:

receiving updated information associated with the aquatic epidemic;

determining an updated threat level associated with the aquatic epidemic for the location within the body of water based on the updated information and the water flow data; and generating an indication of the updated threat level.

4. The method of claim 1, wherein the determining of the threat level includes determining a time at which the aquatic epidemic will arrive at the location within the body of water and a severity of the aquatic epidemic.

5. The method of claim 1, wherein the generated indication of the threat level includes at least one of an electronic message or a visual message.

6. The method of claim 1, wherein the determining of the threat level is performed using at least one of a Lagrangian particle tracking method or a Eulerian particle tracking method.

7. The method of claim 1, wherein the aquatic epidemic includes at least one of a biological epidemic or a pollution epidemic.

8. A system for providing an aquatic epidemic alert, comprising:

a processor executing instructions stored in a memory device, wherein the processor, when executing the instructions:

receives information associated with an aquatic epidemic in a body of water, the aquatic epidemic including at least one of infectious agents carried by aquatic wildlife and infectious organisms floating in the body of water;

determines a threat level associated with the aquatic epidemic for a location within the body of water based on the information associated with the aquatic epidemic and water flow data associated with the body of water; and causes an indication of the threat level to be generated.

9. The system of claim 8, wherein the information associated with the aquatic epidemic includes at least one of a position of the aquatic epidemic within the body of water or an extent of the aquatic epidemic.

10. The system of claim 8, wherein the processor further:

receives updated information associated with the aquatic epidemic;

determines an updated threat level associated with the aquatic epidemic for the location within the body of water based on the updated information and the water flow data; and generates an indication of the updated threat level.

11. The system of claim 8, wherein the determining of the threat level includes determining a time at which the aquatic epidemic will arrive at the location within the body of water and a severity of the aquatic epidemic.

12. The system of claim 8, wherein the generated indication of the threat level includes at least one of an electronic message or a visual message.

13. The system of claim 8, wherein the determining of the threat level is performed using at least one of a Lagrangian particle tracking method or a Eulerian particle tracking method.

14. The system of claim 8, wherein the aquatic epidemic includes at least one of a biological epidemic or a pollution epidemic.

15. A computer program product for providing an aquatic epidemic alert by a processor executing instructions stored in a memory device, the computer program product comprising a non-transitory computer-readable storage medium having computer-readable program code portions stored therein, the computer-readable program code portions comprising:

an executable portion that receives information associated with an aquatic epidemic in a body of water, the aquatic epidemic including at least one of infectious agents carried by aquatic wildlife and infectious organisms floating in the body of water;

an executable portion that determines a threat level associated with the aquatic epidemic for a location within the body of water based on the information associated with the aquatic epidemic and water flow data associated with the body of water; and an executable portion that causes an indication of the threat level to be generated.

16. The computer program product of claim 15, wherein the information associated with the aquatic epidemic includes at least one of a position of the aquatic epidemic within the body of water or an extent of the aquatic epidemic.

17. The computer program product of claim 15, wherein the computer-readable program code portions further include:

an executable portion that receives updated information associated with the aquatic epidemic;

an executable portion that determines an updated threat level associated with the aquatic epidemic for the location within the body of water based on the updated information and the water flow data; and an executable portion that generates an indication of the updated threat level.

18. The computer program product of claim 15, wherein the determining of the threat level includes determining a time at which the aquatic epidemic will arrive at the location within the body of water and a severity of the aquatic epidemic.

19. The computer program product of claim 15, wherein the generated indication of the threat level includes at least one of an electronic message or a visual message.

20. The computer program product of claim 15, wherein the determining of the threat level is performed using at least one of a Lagrangian particle tracking method or a Eulerian particle tracking method.

21. The computer program product of claim 15, wherein the aquatic epidemic includes at least one of a biological epidemic or a pollution epidemic.

* * * * *